US010962176B2

(12) United States Patent
Liu et al.

(10) Patent No.: US 10,962,176 B2
(45) Date of Patent: Mar. 30, 2021

(54) LED LIGHT SOURCE DEVICE

(71) Applicant: OPPLE LIGHTING CO., LTD., Shanghai (CN)

(72) Inventors: Chaobo Liu, Shanghai (CN); Hongbo Wang, Shanghai (CN); Kun Bai, Shanghai (CN); Liang Cao, Shanghai (CN)

(73) Assignee: Opple Lighting Co., Ltd., Shanghai (CN)

( * ) Notice: Subject to any disclaimer, the term of this patent is extended or adjusted under 35 U.S.C. 154(b) by 94 days.

(21) Appl. No.: 15/856,731

(22) Filed: Dec. 28, 2017

(65) Prior Publication Data

US 2018/0119891 A1 May 3, 2018

Related U.S. Application Data

(63) Continuation of application No. PCT/CN2016/112701, filed on Dec. 28, 2016.

(30) Foreign Application Priority Data

Dec. 31, 2015 (CN) ..... 201511026707.0
Dec. 31, 2015 (CN) ..... 201511026834.0
(Continued)

(51) Int. Cl.
*F21K 9/232* (2016.01)
*F21V 7/00* (2006.01)
(Continued)

(52) U.S. Cl.
CPC ..... *F21K 9/232* (2016.08); *F21K 9/237* (2016.08); *F21K 9/238* (2016.08); *F21V 7/0016* (2013.01);
(Continued)

(58) Field of Classification Search
CPC ..... F21K 9/232; F21K 9/237; F21K 9/238; F21K 9/235; F21V 3/10; F21V 3/12;
(Continued)

(56) References Cited

U.S. PATENT DOCUMENTS 5,749,646 A * 5/1998 Brittell ..... F21S 10/02 362/231
6,183,100 B1 * 2/2001 Suckow ..... B60Q 1/2611 362/35
(Continued)

FOREIGN PATENT DOCUMENTS

CN 101874176 A 10/2010
CN 202327993 U 7/2012
(Continued)

OTHER PUBLICATIONS

Chinese Office Action issued in CN201521135219.9, dated Apr. 25, 2016, 1 page.
(Continued)

*Primary Examiner* — Bryon T Gyllstrom
*Assistant Examiner* — James M Endo
(74) *Attorney, Agent, or Firm* — Arch & Lake LLP

(57) ABSTRACT

An LED light source device includes an LED light source dot at least emitting light of one color and a light emission portion emitting light of different colors. The light emission portion includes a light emission portion for a main illumination and for emitting a white light and a light emission portion for a scene illumination and for emitting a colored light. The light emission portion for the main illumination emits the white light and the light emission portion for the scene illumination emits the colored light simultaneously. The LED light source device is a bulb lamp, a candle lamp or other lamps of which a front side and a lateral side both emits light.

17 Claims, 6 Drawing Sheets

(30) Foreign Application Priority Data

Dec. 31, 2015 (CN) ..... 201521135219.9
Dec. 31, 2015 (CN) ..... 201521135272.9

(51) Int. Cl.

| | |
|---|---|
| ***F21V 13/04*** | (2006.01) |
| ***F21K 9/238*** | (2016.01) |
| ***F21K 9/237*** | (2016.01) |
| ***F21Y 105/18*** | (2016.01) |
| ***F21Y 113/13*** | (2016.01) |
| ***F21K 9/69*** | (2016.01) |
| ***F21V 7/04*** | (2006.01) |
| ***F21V 3/10*** | (2018.01) |
| ***F21V 3/06*** | (2018.01) |
| ***F21K 9/66*** | (2016.01) |
| ***F21Y 115/10*** | (2016.01) |
| ***F21V 3/02*** | (2006.01) |

(52) U.S. Cl.
CPC ..... *F21V 13/04* (2013.01); *F21K 9/66* (2016.08); *F21K 9/69* (2016.08); *F21V 3/02* (2013.01); *F21V 3/06* (2018.02); *F21V 3/10* (2018.02); *F21V 7/04* (2013.01); *F21Y 2105/18* (2016.08); *F21Y 2113/13* (2016.08); *F21Y 2115/10* (2016.08)

(58) Field of Classification Search
CPC ..... F21V 7/0016; F21V 13/04; F21V 3/02; F21Y 2105/18
See application file for complete search history.

(56) References Cited

U.S. PATENT DOCUMENTS 6,464,373 B1 * 10/2002 Petrick ..... F21V 11/14 257/E25.028
8,240,880 B2 * 8/2012 Chen ..... F21S 8/06 362/235
8,573,806 B1 * 11/2013 Moon ..... F21V 7/06 362/249.02
2011/0103054 A1 * 5/2011 Chang ..... F21V 5/02 362/235
2011/0103064 A1 * 5/2011 Coe-Sullivan ..... H01L 33/502 362/293
2011/0215699 A1 * 9/2011 Le ..... F21V 3/00 313/46
2011/0298355 A1 * 12/2011 Van de Ven ..... F21V 3/04 313/483
2011/0305014 A1 * 12/2011 Peck ..... G02B 19/0019 362/235
2012/0300453 A1 * 11/2012 Zhou ..... F21V 29/505 362/235
2013/0027928 A1 * 1/2013 Kang ..... F21K 9/232 362/235
2013/0214666 A1 * 8/2013 Leung ..... F21V 13/04 313/46
2013/0229801 A1 * 9/2013 Breidenassel ..... F21V 3/02 362/235
2013/0235582 A1 * 9/2013 Breidenassel ..... F21V 7/04 362/241
2013/0314918 A1 * 11/2013 Kang ..... F21V 3/00 362/235
2014/0160748 A1 * 6/2014 Tsai ..... F21K 9/60 362/235
2015/0267896 A1 * 9/2015 Moon ..... F21V 7/16 362/310

FOREIGN PATENT DOCUMENTS

CN 203980046 U 12/2014
CN 104482448 A 4/2015
CN 104633516 A 5/2015
CN 205331867 U 6/2016
CN 205655122 U 10/2016

OTHER PUBLICATIONS

Chinese Office Action issued in CN201521135219.9, dated Jun. 24, 2016, 1 page.
International Search Report and Written Opinion (including English translation) issued in PCT/CN2016/112701, dated Feb. 22, 2017, _ pages.

* cited by examiner

LED LIGHT SOURCE DEVICE

CROSS-REFERENCE TO RELATED APPLICATIONS

This application is based upon and claims the priority of PCT patent application No. PCT/CN2016/112701 filed on Dec. 28, 2016 which claims the priority of Chinese Patent Application No. 201511026707.0 filed on Dec. 31, 2015, Chinese Patent Application No. 201511026834.0 filed on Dec. 31, 2015, Chinese Patent Application No. 201521135219.9 filed on Dec. 31, 2015, and Chinese Patent Application No. 201521135272.9 filed on Dec. 31, 2015, the entire contents of all of which are hereby incorporated by reference herein for all purposes.

TECHNICAL FIELD

The present disclosure relates to an illumination device, in particular, relates to a Light-Emitting Diode (LED) light source device and a lamp.

BACKGROUND

Generally, a bulb lamp severing as a light source is individually used or is placed in other lamps such as a ceiling lamp, a table lamp, a decorative lamp and the like.

However, no matter which kind of application, the bulb lamp used as the light source only has a light emission surface of one color at a same time, i.e., both a main illumination and a background illumination provided by the bulb lamp have a same color, and thus the bulb lamp cannot simultaneously accomplish a scene illumination and a function illumination.

In a first aspect, a LED light source device may include a light source including at least one LED dot emitting light of a first color. The LED light source device may further include a light emission portion emitting light of different colors. The light emission portion includes a first emission portion and a second emission portion. The first emission portion is configured to emit a white light for illumination. The second emission portion is configured to emit a colored light for a scene illumination. The first emission portion emits the white light simultaneously when the second emission portion emits the colored light.

In a second aspect, a lamp includes a light source including at least one Light-Emitting Diode (LED) dot emitting light of a first color. The lamp may further include a light cover comprising a front side and a lateral side respectively emitting light of different colors. The front side is configured to emit a white light for illumination. The lateral side is configured to emit a colored light for a scene illumination simultaneously when the front side emits the white light.

Therefore, in order to overcome the above defects, it is necessary to provide an improved LED light source device.

SUMMARY

The present disclosure aims to provide a LED light source and a lamp.

In a first aspect, a LED light source device may include a light source including at least one LED dot emitting light of a first color. The LED light source device may further include a light emission portion emitting light of different colors. The light emission portion includes a first emission portion and a second emission portion. The first emission portion is configured to emit a white light for illumination.

The second emission portion is configured to emit a colored light for a scene illumination. The first emission portion emits the white light simultaneously when the second emission portion emits the colored light.

In a second aspect, a lamp includes a light source including at least one Light-Emitting Diode (LED) dot emitting light of a first color. The lamp may further include a light cover comprising a front side and a lateral side respectively emitting light of different colors. The front side is configured to emit a white light for illumination. The lateral side is configured to emit a colored light for a scene illumination simultaneously when the front side emits the white light.

The above description merely is an outline of the technical solution of the present disclosure; in order to know the technical means of the present disclosure more clearly so that implementation may be carried out according to contents of the specification, and in order to make the above and other objectives, characteristics and advantages of the present disclosure more clear and easy to understand, specific embodiments of the present disclosure will be described in detail below.

BRIEF DESCRIPTION OF THE DRAWINGS

By reading the detailed description of the embodiments below, various other advantages and benefits will be clear for those skilled in the art. The drawings merely are used for showing the embodiments, but should not be considered as limitation to the present disclosure. Moreover, in all drawings, the same reference signs represent the same parts. In the drawings.

DETAILED DESCRIPTION

Figure 1:
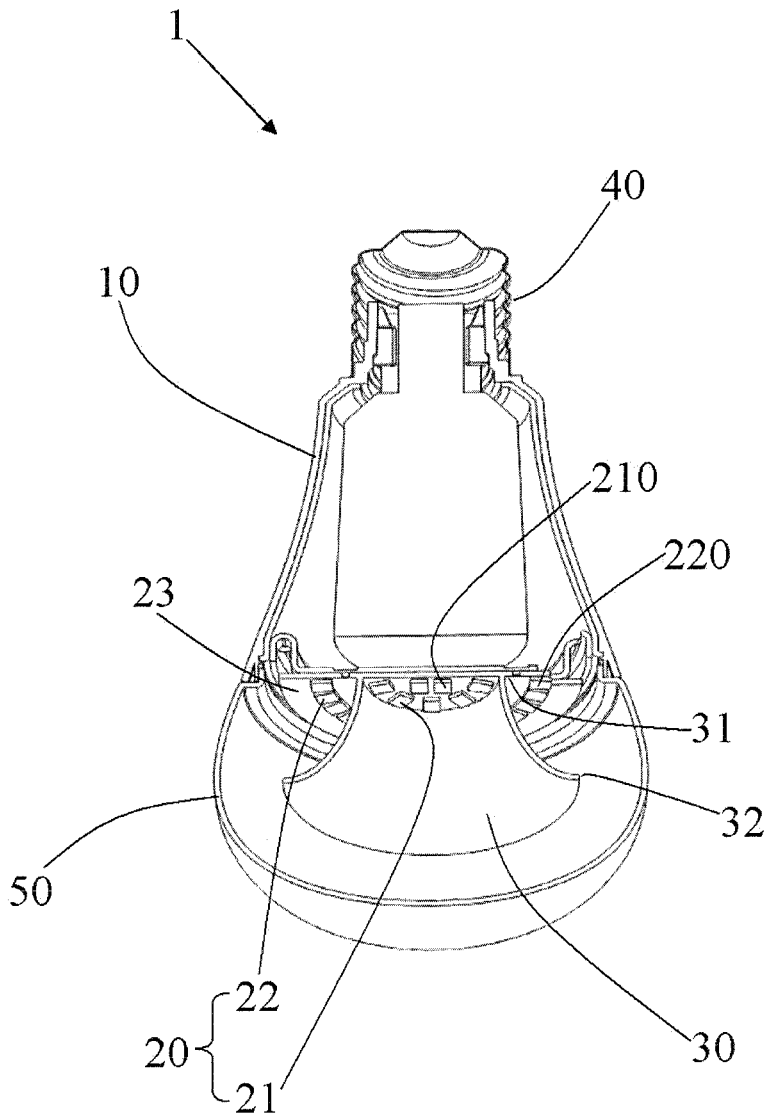
FIG. 1 is a sectional view of a first aspect of an LED light source device of the present disclosure.

Exemplary embodiments of the present disclosure will be described in more details with reference to the drawings. The exemplary embodiments of the present disclosure are shown in the drawings, but it should be understood that the present disclosure can be implemented in various forms and should not be limited by the embodiments described herein. In addition, providing those embodiments aims to understand the present disclosure more thoroughly and integrally transmit the scope of the present disclosure to those skilled in the art.

The present disclosure provides an LED light source device. The LED light source device for example is a bulb lamp, a candle lamp or a lamp tube and the like. The LED light source device includes an LED light source dot at least emitting light of one color and a light emission portion emitting light of different colors. The light emission portion includes a light emission portion for a main illumination and for emitting a white light and a light emission portion for a scene illumination and for emitting a colored light, and the light emission portion for the main illumination emits the white light and the light emission portion for the scene illumination emits the colored light simultaneously. The white light refers to a light with a color temperature of 2,700K to 6,500K; and the colored light refers to a light with color, which is different from the white light, such as a red light, a blue light and the like. "The light emission portion for the main illumination emits the white light and the light emission portion for the scene illumination emits the colored light simultaneously" means that the light emission portion for the main illumination and the light emission portion for the scene illumination work at a same time, but does not mean that they are strictly simultaneously turned on or turned off. When the light emission portion for the main illumination and the light emission portion for the scene illumination are turned on or turned off, slight time difference may exist between the light emission portion for the main illumination and the light emission portion for the scene illumination.

Figure 2:
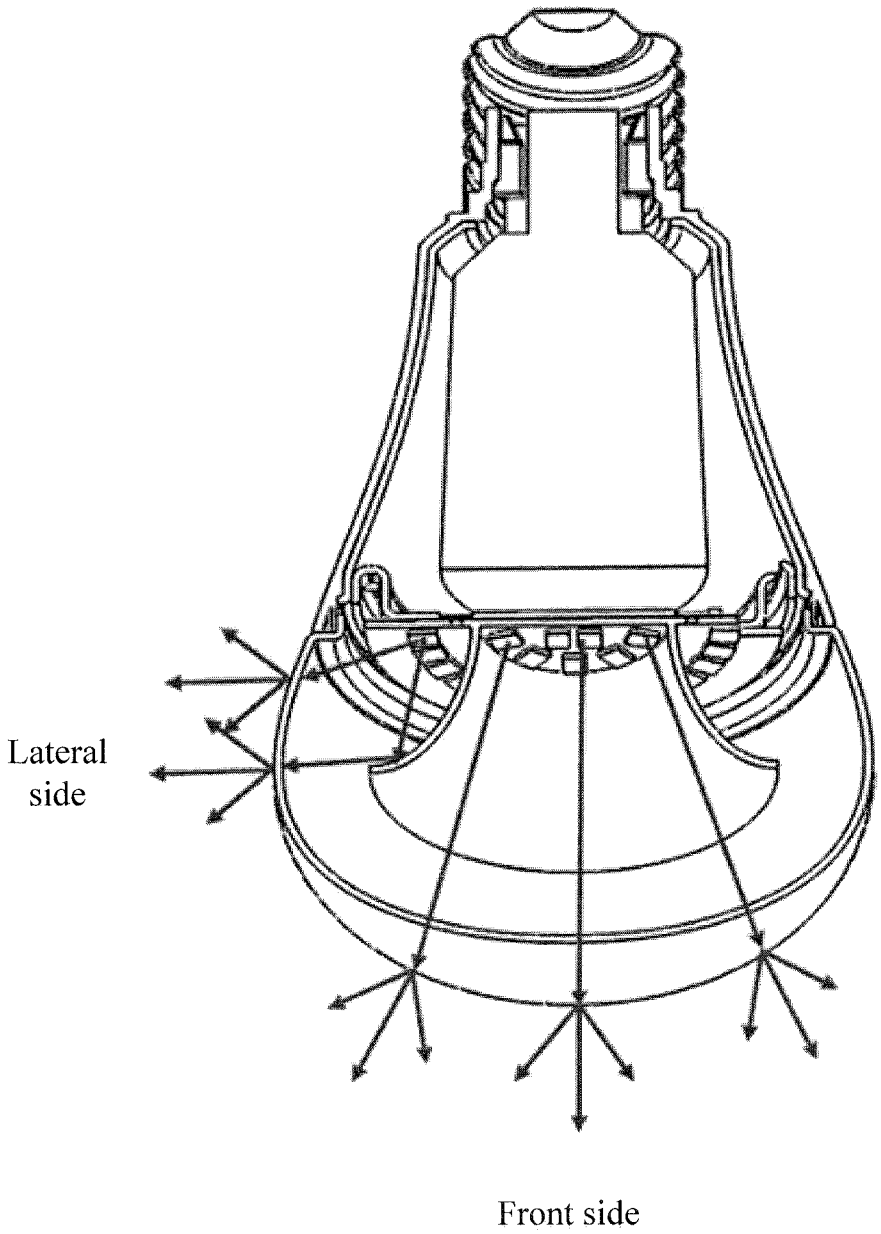
FIG. 2 is a schematic view of an optical path of the first aspect of the LED light source device of the present disclosure.

For example, with reference to FIG. 1 and FIG. 2, an LED light source device 1 according to an aspect of the present disclosure includes a main body 10, an LED light source 20 installed on the main body 10, and a reflector 30. The LED light source 20 includes a first light source component 21 and a second light source component 22 positioned in a periphery of the first light source component 21. The first light source component 21 emits the white light for the main illumination, the second light source component 22 emits the colored light for the scene illumination, and the reflector 30 is provided with a first end 31 positioned between the first light source component 21 and the second light source component 22 and a second end 32 extending from the first end 31 and crossing the second light source component 22. The light of the second light source component 22, which propagates towards the direction of the reflector 30, is emitted after being reflected, so that an angle of the light emitted by the second light source component 22 is controlled. Such structure enables the LED light source device 1 to have the white light which emits mainly downwards and is used for the main illumination and also have the colored light which emits mainly towards a lateral side and is used for the scene illumination, and the structure of the LED light source device 1 with both the main illumination and the scene illumination functions is very simple.

The second light source component 22 is of a ring shape, and the second light source component 22 is uniformly distributed in the periphery of the first light source component 21.

The reflector 30 is of a coronal shape, the second end 32 of the reflector 30 is far away from the first light source component 21, the first end 31 is close to the first light source component 21, and a width of the first end 31 is smaller than a width of the second end 32.

Figure 3:
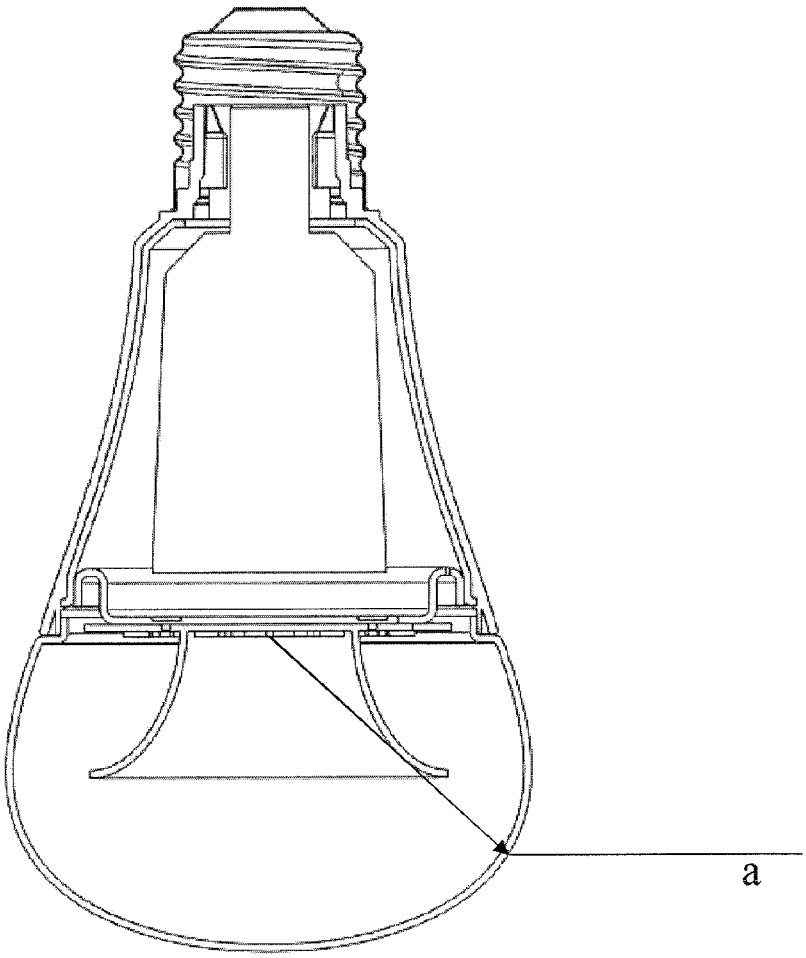
FIG. 3 is a schematic view of a light effect explanation of the first aspect of the LED light source device of the present disclosure.

The LED light source device 1 further includes a terminal portion 40 and a shell 50. The shell 50 and the terminal portion 40 are respectively installed on the main body 10. The terminal portion 40 is electrically and mechanically connected with an external installation device (not shown in the drawings), and the shell 50 is made of a transparent or semitransparent material. In the embodiment, the second end 32 of the reflector 30 is separated from the shell 50, i.e., the second end 32 of the reflector 30 is not connected with the shell 50 and positioned inside the shell 50. With reference to FIG. 3, seeing from the outside of the shell 50, by taking a line a as a boundary, the white light is positioned below the line a, and the colored light is positioned above the line a. For example, a light distribution angle of the light of the second light source component 22 is regulated by changing a height, a width and/or a shape of the reflector 30. In other embodiments, the second end 32 of the reflector 30 for example is connected with the shell 50; and in this case, the white light is positioned below a connection joint of the reflector 30 and the shell 50, and the colored light is positioned above the connection joint of the reflector 30 and the shell 50.

The first light source component 21 and the second light source component 22 for example have a same substrate 23. The first light source component 21 comprises a plurality of white-light LED light source dots 210, and the second light source component 22 comprises a plurality of LED light source dots 220 for emitting the colored light.

Figure 4:
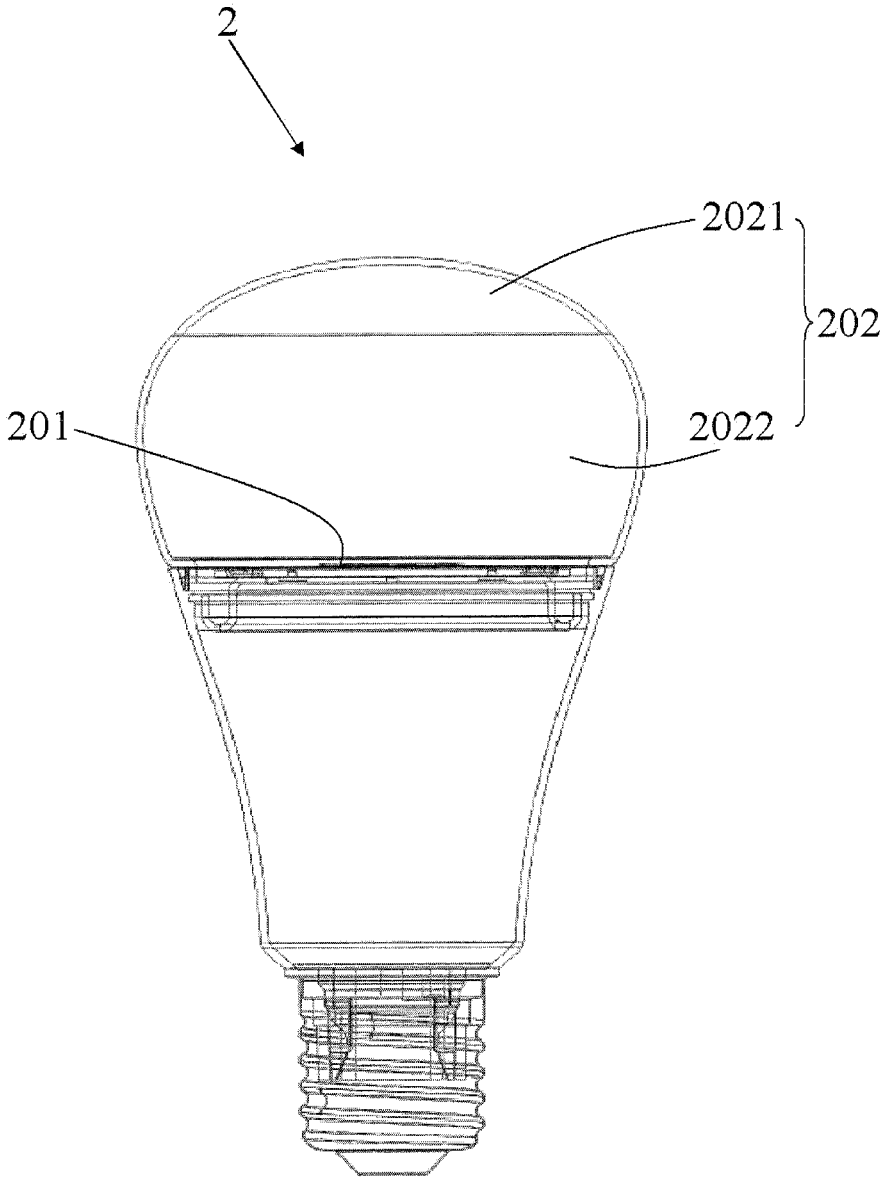
FIG. 4 is a side view of a second aspect of the LED light source device of the present disclosure.
Figure 5:
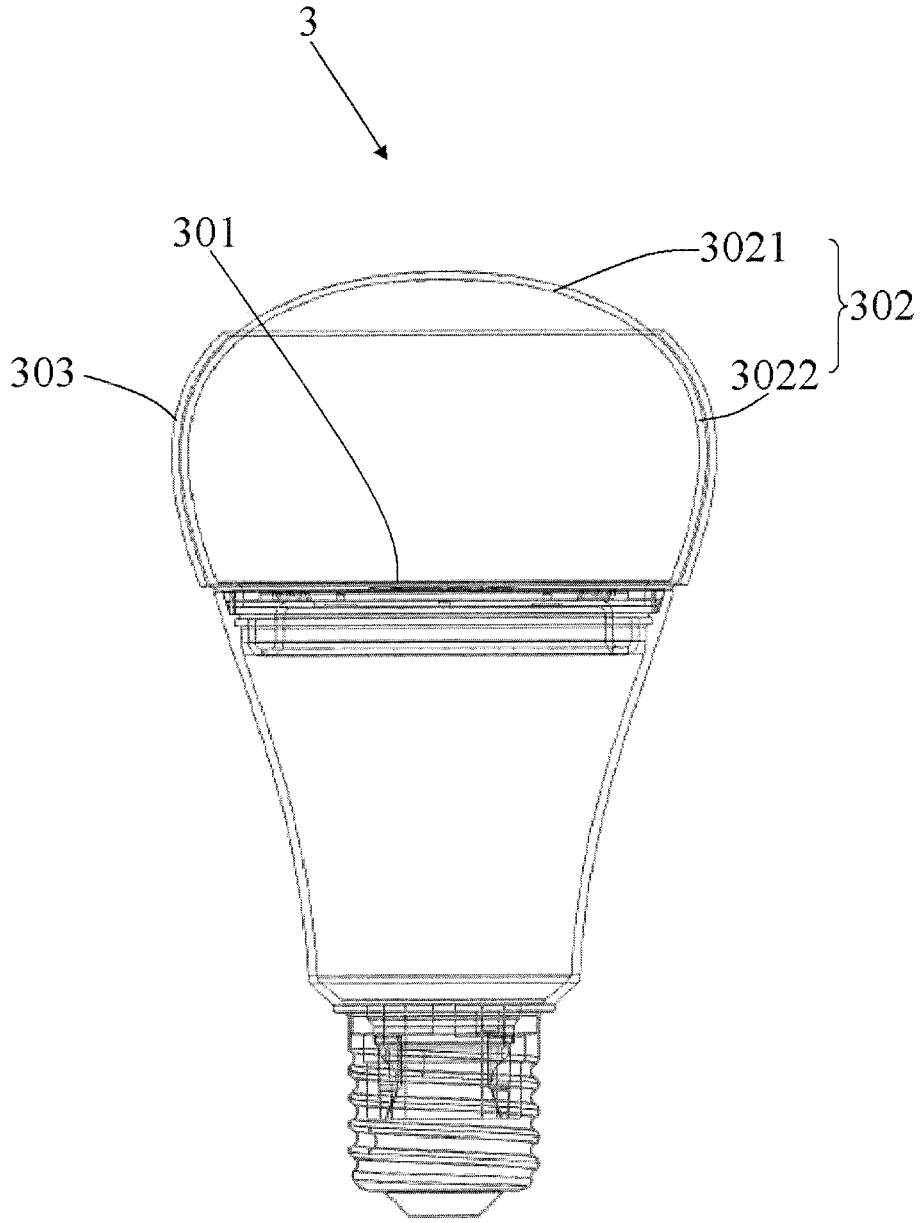
FIG. 5 is a side view of a third aspect of the LED light source device of the present disclosure.
Figure 6:
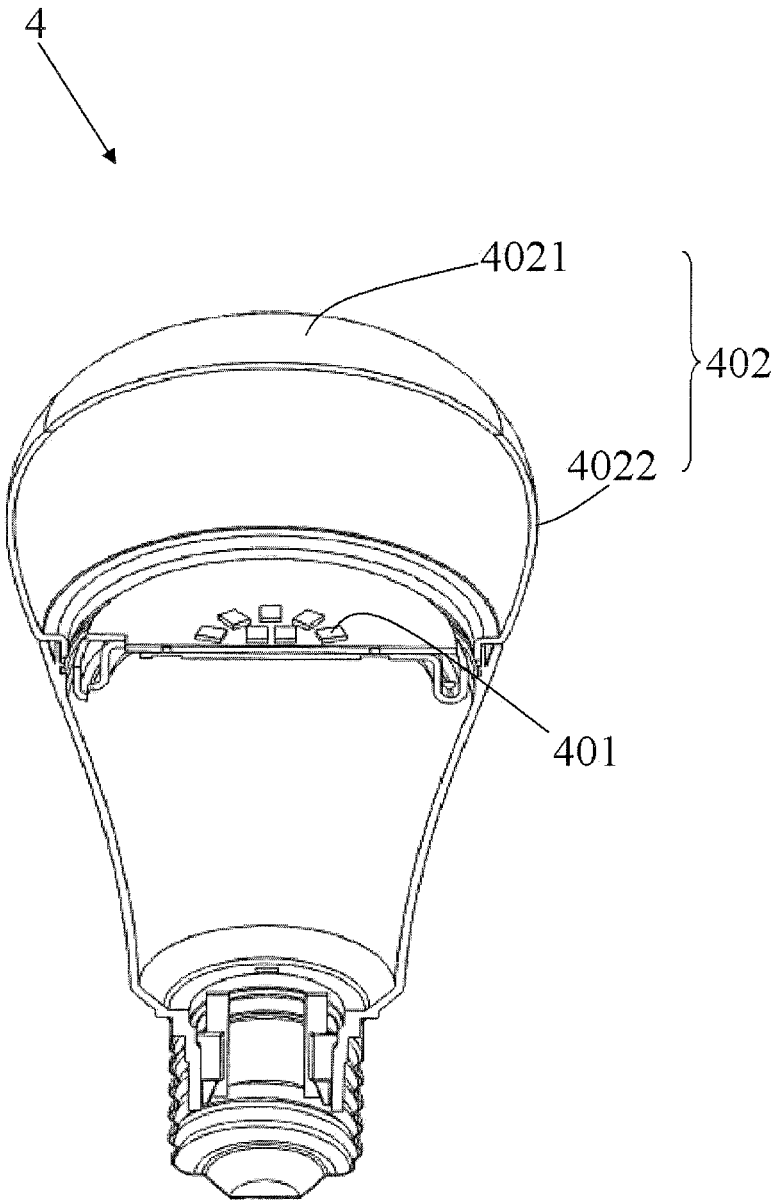
FIG. 6 is a side view of a fourth aspect of the LED light source device of the present disclosure.

The LED light source dots 220 of the second light source component 22 are arranged in a circular ring shape. In other embodiments, the LED light source dots 220 of the second light source component 22 for example is arranged in other ring shapes, such as a rectangular ring shape and the like, and ring-shaped arrangement of the LED light source dots 220 of the second light source component 22 makes light distribution more uniform. In the embodiment, the LED light source device 1 is the bulb lamp, and in other embodiments, the LED light source device 1 for example is the candle lamp or a light source device in other forms. It should be noted that, light needs to be emitted from the lateral side of the LED light source device 1 so as to accomplish the main illumination at the front side and the color scene illumination at the lateral side. For example, in FIG. 1, the light source 21 is facing the front side while the light source 23 on the left is facing the lateral side. In FIGS. 4-6, portions 2021, 3021, 4021 are on the front side while portions 2022, 3022, 4022 are on the lateral side.

With reference to FIG. 4, an LED light source device 2 according to a second aspect of the present disclosure is only provided with a white-light LED light source dot 201. The light emission portion of the LED light source device 2 is a shell 202 of the LED light source device 2. The light emission portion for the main illumination and the light emission portion for the scene illumination are respectively positioned at different positions of the shell 202. The light emission portion for the main illumination is a first portion 2021 of the shell 202, the light emission portion for the scene illumination is a second portion 2022 of the shell 202, and the light emission portion for the scene illumination is provided with a color coating (not shown). According to the LED light source device 2 provided by the embodiment, a conventional light source device structure is utilized, and just the shell 202 is divided into portions of different colors, so that the LED light source device 2 provided by the present disclosure implements both the main illumination and the scene illumination by the simple structure.

With reference to FIG. 5, an LED light source device 3 according to a third aspect of the present disclosure is only provided with a white-light LED light source dot 301. The light emission portion of the LED light source device 3 is a shell 302 of the LED light source device 3. The light emission portion for the main illumination and the light emission portion for the scene illumination are respectively positioned at different positions of the shell 302. The light emission portion for the main illumination is one portion 3021 of the shell 302, the light emission portion for the scene illumination includes the other portion 3022 of the shell 302 and a color cover 303 covering the other portion of the shell 302. In the embodiment, the color cover 303 for example is a silica gel cover; and in other embodiments, the color cover 303 for example is made of other elastic materials.

With reference to FIG. 6, an LED light source device 4 according to a fourth aspect of the present disclosure is only provided with a white-light LED light source dots 401. The light emission portion is a shell 401 of the LED light source device 4. The shell 401 includes a transparent or white semitransparent first portion 4021 and a colored second portion 4022. The first portion 4021 and the second portion 4022 are formed separately and then are assembled together, the first portion 4021 is used as the light emission portion for the main illumination, and the second portion 4022 is used as the light emission portion for the scene illumination.

In order to achieve the above objects, the present disclosure employs the following technical solutions: a LED light source device comprises: an LED light source dot at least emitting light of one color, and a light emission portion emitting light of different colors, the light emission portion includes a light emission portion for a main illumination and for emitting a white light and a light emission portion for a scene illumination and for emitting a colored light, and the light emission portion for the main illumination emits the white light and the light emission portion for the scene illumination emits the colored light simultaneously.

For example, the LED light source device further includes a main body and a reflector, the LED light source dot is installed on the main body, the LED light source dot includes a first light source component and a second light source component positioned in a periphery of the first light source component, the first light source component emits the white light for the main illumination, the second light component emits the colored light for the scene illumination, and the reflector is provided with a first end positioned between the first light source component and the second light source component and a second end extending from the first end and crossing the second light source component.

For example, the second light source component is of a ring shape, and the second light source component is uniformly distributed in the periphery of the first light source component.

For example, the reflector is of a coronal shape, the second end of the reflector is far away from the first light source component, the first end of the reflector is close to the first light source component, and a width of the first end is smaller than a width of the second end.

For example, the LED light source device further includes a terminal portion and a shell, the shell and the terminal portion are respectively installed on the main body, the terminal portion is electrically and mechanically connected with an external installation device, and the shell is made of a transparent or semitransparent material.

For example, the second end of the reflector is connected with the shell.

For example, the second end of the reflector is positioned inside the shell and is separated from the shell.

For example, the first light source component and the second light source component have a same substrate, the first light source component includes a plurality of white-light LED light source dots with a color temperature of 2,700K to 6,500K, and the second light source component includes a plurality of LED light source dots for emitting the colored light.

For example, the plurality of LED light source dots of the second light source component are arranged in a circular ring shape.

For example, the light emission portion is a shell of the LED light source device, the light emission portion for the main illumination and the light emission portion for the scene illumination are respectively positioned at different positions of the shell, the light emission portion for the main illumination is a first portion of the shell, the light emission portion for the scene illumination is a second portion of the shell, and the light emission portion for the scene illumination is provided with a color coating.

For example, the light emission portion is a shell of the LED light source device, the light emission portion for the main illumination and the light emission portion for the scene illumination are respectively positioned at different positions of the shell, the light emission portion for the main illumination is one portion of the shell, the light emission portion for the scene illumination includes the other portion of the shell and a color cover covering the other portion of the shell.

For example, the color cover is made of an elastic material.

For example, the color cover is a color silica gel cover.

For example, the light emission portion is a shell of the LED light source device, the shell includes a transparent or white semitransparent first portion and a colored second portion, the first portion and the second portion are formed separately and then are assembled together, the first portion is used as the light emission portion for the main illumination, and the second portion is used as the light emission portion for the scene illumination.

For example, the LED light source dot only is a white-light LED light source dot.

For example, the LED light source device is a bulb lamp, a candle lamp or other lamps of which a front side and a lateral side both emits light.

Compared to the prior art, the LED light source device disclosed by the present disclosure has the following advantages that: the main illumination at the front side and the color scene illumination at the lateral side are achieved by a very simple structure, and the LED light source device is wide in application and convenient and simple in replacement.

It should be noted that the embodiments of the present disclosure comprises embodiments and are not intended to limit the present disclosure in any form, any skilled in the art may change or modify the embodiments into equivalent effective embodiments by utilizing the technical contents disclosed above, and any changes or equivalent variations and modifications made to the embodiments according to the technical essence of the present disclosure without departing from the contents of the technical solutions of the present disclosure are within the scope of the technical solutions of the disclosure.

The invention claimed is:

1. A Light-Emitting Diode (LED) light source device, comprising:

a light source including at least one LED light source dot emitting light of a first color a light emission portion emitting light of different colors, wherein the light emission portion is a shell, the light emission portion comprises a first emission portion and a second emission portion, wherein the first emission portion and the second emission portion are formed separately in different colors, and are assembled together to be respectively disposed at different positions of the shell, the first emission portion is configured to emit a white light for a main illumination, and the second emission portion is configured to emit a colored light for a scene illumination, and the first emission portion emits the white light simultaneously when the second emission portion emits the colored light, wherein the LED light source dot includes a first light source component and a second light source component disposed on a same substrate, the first light source component includes a plurality of white-light LED light source dots facing a front side, the second light source component includes a plurality of LED light source dots for emitting the colored light facing a lateral side that is different from facing the front side and the plurality of LED light source dots are close to each other to form a ring, the first light source component emits the white light downwards and is used for the main illumination and the second light source component emits the colored light towards the lateral side for the scene illumination, and a separation line for the white light and the colored light on the shell is provided wherein the white light is positioned below the separation line and the colored light is positioned above the separation line; and a reflector having a coronal shape, wherein the reflector comprises a first end and a second end, wherein the first end is disposed between the first light source component and the second light source component, and the second end extends from the first end such that the reflector crosses the second light source component, wherein the first light source component and the second light source component are disposed on the same substrate, and wherein the second end of the reflector is positioned inside the shell and is separated from the shell.

2. The LED light source device according to claim 1, further comprising:

a main body, wherein the LED light source dot is disposed on the main body, wherein the first light source component and the second light source component positioned in a periphery of the first light source component, the first light source component emits the white light for the main illumination, and wherein the second light component emits the colored light for the scene illumination.

3. The LED light source device according to claim 2, wherein the second light source component is of a rectangular ring shape, and the second light source component is uniformly distributed in the periphery of the first light source component.

4. The LED light source device according to claim 2, wherein the second end of the reflector is far away from the first light source component, the first end of the reflector is close to the first light source component, and a width of the first end is smaller than a width of the second end.

5. The LED light source device according to claim 2, wherein the LED light source device further includes a terminal portion, the shell and the terminal portion are respectively installed on the main body, the terminal portion is electrically and mechanically connected with an external installation device, and the shell is made of a transparent or semitransparent material.

6. The LED light source device according to claim 2, wherein the plurality of LED light source dots of the second light source component are arranged in a circular ring shape.

7. The LED light source device according to claim 1, wherein the light emission portion is the shell of the LED light source device, the light emission portion for the main illumination and the light emission portion for the scene illumination are respectively positioned at different positions of the shell, the light emission portion for the main illumination is a first portion of the shell, the light emission portion for the scene illumination is a second portion of the shell, and the light emission portion for the scene illumination is provided with a color coating.

8. The LED light source device according to claim 1, wherein the light emission portion comprises the shell of the LED light source device, the light emission portion for the main illumination and the light emission portion for the scene illumination are respectively positioned at different positions of the shell, the light emission portion for the main illumination is one portion of the shell, the light emission portion for the scene illumination includes the other portion of the shell and a color cover covering the other portion of the shell.

9. The LED light source device according to claim 8, wherein the color cover is made of an elastic material.

10. The LED light source device according to claim 9, wherein the color cover is a color silica gel cover.

11. The LED light source device according to claim 1, wherein the light emission portion comprises the shell of the LED light source device, the shell includes a transparent or white semitransparent first portion and a colored second portion, the first portion is used as the light emission portion for the main illumination, and the second portion is used as the light emission portion for the scene illumination.

12. The LED light source device according to claim 1, wherein the first light source component only is a white-light LED light source dot.

13. A lamp, comprising:

a light source including at least one Light-Emitting Diode (LED) light source dot emitting light of a first color, a reflector comprising a first end and a second end; and a light cover comprising a front side and a lateral side respectively emitting light of different colors, wherein the light cover is a shell, and the front side and the lateral side are formed separately in different colors and are assembled together to be respectively disposed at different positions of the shell, the front side is configured to emit a white light for a main illumination, and the lateral side is configured to emit a colored light for a scene illumination simultaneously when the front side emits the white light, wherein the LED light source dot includes a first light source component and a second light source component disposed on a same substrate, the same substrate extends laterally towards the shell forming a plane, the first light source component faces the front side, and the second light source component faces the lateral side that is different from the front side and a plurality of LED light source dots of the second light source component are close to each other to form a ring, the first light source component emits the white light downwards and is used for the main illumination and the second light source component emits the colored light towards the lateral side for the scene illumination, and a separation line for the white light and the colored light on the shell is provided wherein the white light is positioned below the separation line and the colored light is positioned above the separation line, wherein the reflector is of a coronal shape, and the reflector comprises the first end and the second end, wherein the first end is disposed between the first light source component and the second light source component, and the second end extends from the first end such that the reflector crosses the second light source component, wherein the first light source component and the second light source component are disposed on the same substrate, wherein the reflector extends horizontally away from the same substrate from the first end, and curves concavely towards the shell, and wherein the second end of the reflector is positioned inside the shell and is separated from the shell.

14. The lamp according to claim 13, further comprising:

a main body, wherein the LED light source dot is disposed on the main body, and wherein the first light source component and the second light source component positioned in a periphery of the first light source component, the first light source component emits the white light for the main illumination.

15. The lamp according to claim 14, wherein the second light component emits the colored light for the scene illumination, wherein the first end between the first light source component and the second light source component, and wherein the second end extended from the first end and crossing the second light source component.

16. The lamp according to claim 14, wherein the second light source component is of a rectangular ring shape, and the second light source component is uniformly distributed in the periphery of the first light source component.

17. The lamp according to claim 14, wherein the second end of the reflector is far away from the first light source component, the first end of the reflector is close to the first light source component, and a width of the first end is smaller than a width of the second end.

* * * * *